US005915289A

United States Patent [19]

Hart

[11] Patent Number: 5,915,289

[45] Date of Patent: Jun. 22, 1999

[54] ELECTRONIC CYMBAL APPARATUS

[76] Inventor: Peter Hart, 609 Second Ave., Destin, Fla. 32541

[21] Appl. No.: 08/988,877

[22] Filed: Dec. 12, 1997

[51] Int. Cl.[6] ..... G10D 13/06; G10H 1/057; G10H 3/14

[52] U.S. Cl. ..... 84/738; 84/743; 84/402; 84/422.3; 84/DIG. 12

[58] Field of Search ..... 84/723–746, DIG. 12, 84/402, 422.3

[56] References Cited

U.S. PATENT DOCUMENTS 5,063,821 11/1991 Battle ..... 84/743 X
5,262,585 11/1993 Greene et al. ..... 84/DIG. 12

FOREIGN PATENT DOCUMENTS 2173031 10/1986 United Kingdom ..... 84/402

*Primary Examiner*—Stanley J. Witkowski
*Attorney, Agent, or Firm*—George A. Bode Bode & Associates; Lisa D. Charouel

[57] ABSTRACT

An electronic cymbal apparatus which significantly shortens the vibratory response of the prolonged resonating acoustical tone produced by the percussive impact on an electrically conductive striking surface thereby enabling the pick-up of such shortened vibratory response by a transducer, such as, without limitation, a piezoelectric transducer. The electronic cymbal apparatus utilizes conventional cymbal substrates, such as, without limitation, in the form of a broad-brim hat wherein the use of conventional cymbal substrates allows the musician to employ conventional acoustical "striking" techniques while playing the electronic cymbal apparatus.

18 Claims, 2 Drawing Sheets

FIG. 4
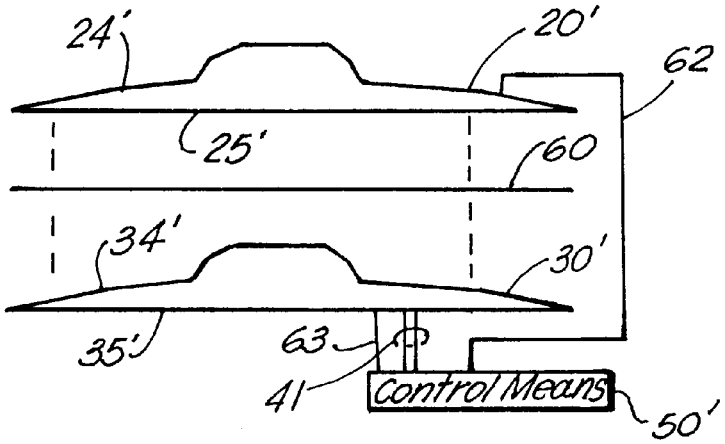
FIG. 5
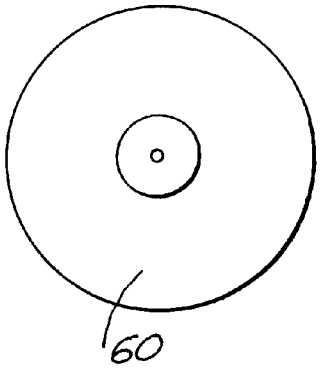
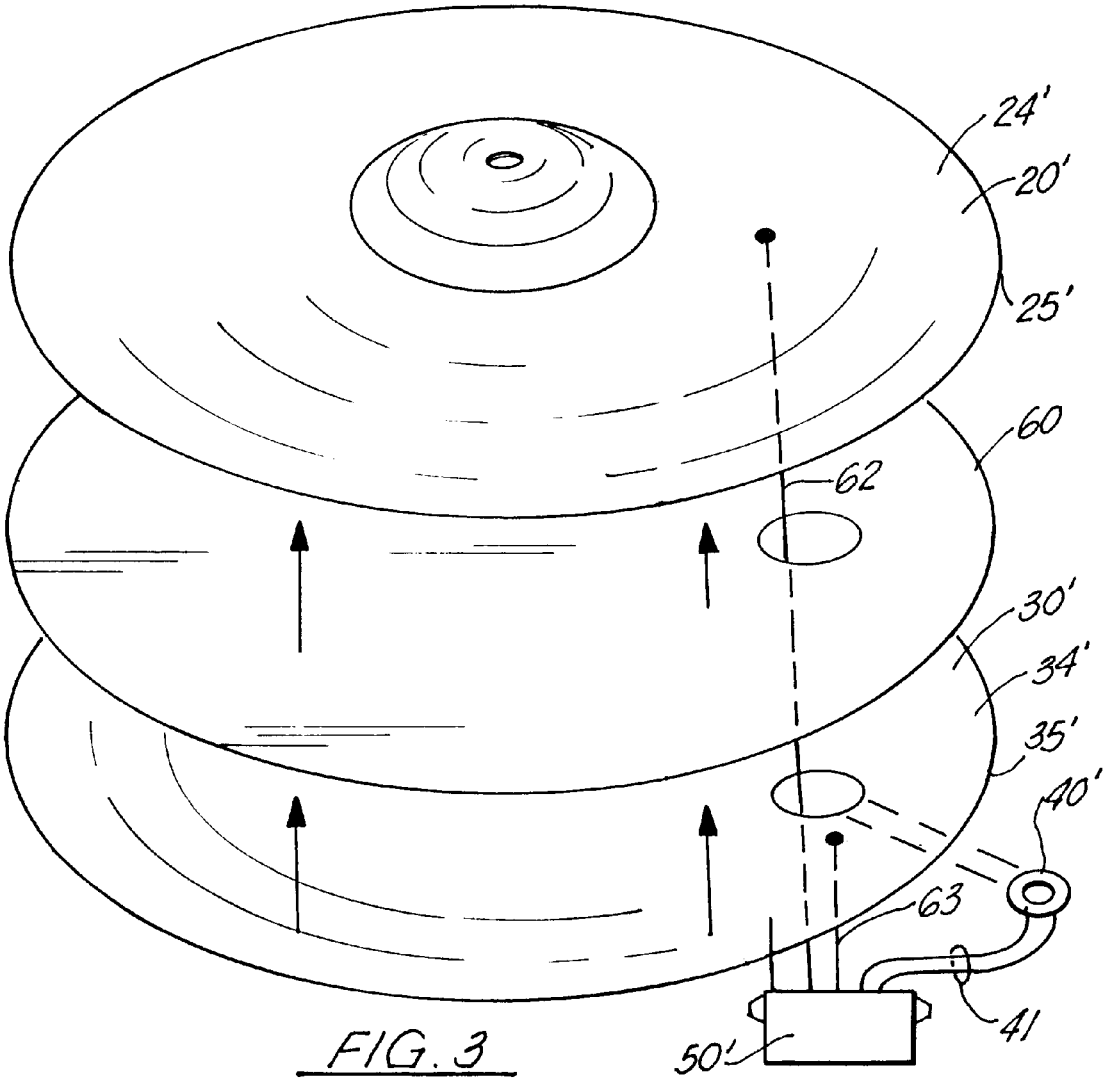
FIG. 3

ELECTRONIC CYMBAL APPARATUS

BACKGROUND OF THE INVENTION

1. Field of the Invention

The present invention relates to electronic percussion instruments and, more particularly, to an electronic cymbal apparatus which significantly shortens the vibratory response having a prolonged resonating acoustical tone produced by percussive impact on an electrically conductive striking surface thereby enabling the pick-up of such shortened vibratory response by a transducer means, such as, without limitation, a piezoelectric transducer. The electronic cymbal apparatus utilizes conventional cymbals, such as, without limitation, in the form of a broad-brim hat wherein the use of conventional cymbals allows the musician to employ conventional acoustical "striking" techniques while playing the electronic cymbal apparatus.

2. General Background

Electronic musical instruments are readily used in the music industry to vary the musical sound produced by such musical instruments. Many electronic musical instruments vary the musical sound via a percussive impact which produces a vibratory response picked up by a pressure transducer such as, without limitation, a piezoelectric transducer. When using such electronic musical instruments for example, electronic drums, it is highly desirable to allow the musician to employ conventional acoustical "striking" techniques while playing the electronic drums. Thereby, the musician need not learn any new "striking" techniques to play such electronic drums. Furthermore, the simulation of the musical sound desired is simplified since such simulation is based on such existing "striking" techniques and the vibratory amplitudes produced from percussive impacts.

Patents present in the art directed to electronic drums are U.S. Pat. No. 4,700,602, by Bozzio; U.S. Pat. No. 4,479,412, by Klynas; and U.S. Pat. No. 4,753,146, by Seiler; all of which use non-electrically conductive striking surfaces having a vibratory response characteristic to such non-electrically conductive striking surfaces.

Since, conventional non-electronic drums provide non-electrically conductive striking surfaces having a shortened vibratory response in comparison to the vibratory response produced by electrically conductive striking surfaces of cymbals, incorporating piezoelectric transducers or the like with such non-electrically conductive striking surfaces having a shortened vibratory response to properly translate the shortened vibratory response of the percussive impact into the desired electrical signal was successful. As a result, musicians did not need to significantly change their playing style or technique to achieve the desired musical sound variations. However, such transducers were not readily transferred to brass percussion instruments such as, without limitation, cymbals. For example, since the cymbal's tone characteristic was a result of a metallic striking surface such as, without limitation, brass or bronze alloy surface, the metallic striking surface when struck produced a prolonged resonating acoustical tone having a prolonged vibratory response. Such prolonged vibratory response was not easily interpreted without error, if at all, by the piezoelectric transducers or any other transducers commercially readily available.

U.S. Pat. No. 5,262,585, by Greene et al. disclose an electronic cymbal system having cymbal members made of ABS plastic, acrylic, or any other impact resistant material which does not produce an acoustically ringing sound similar to that of an actual cymbal.

Another patent present in the art is U.S. Pat. No. 5,076,131, by Patterson, which is directed to a portable and mobile percussion music system, but does not meet the needs of the electronic cymbal apparatus of the present invention.

SUMMARY OF THE PRESENT INVENTION

The preferred embodiment of the apparatus of the present invention solves the aforementioned problems in a straight forward and simple manner. What is provided is an electronic cymbal apparatus which significantly shortens the vibratory response having a prolonged resonating acoustical tone produced by percussive impact on an electrically conductive striking surface thereby enabling the pick-up of such shortened vibratory response by a transducer means, such as, without limitation, a piezoelectric transducer. The electronic cymbal apparatus utilizes conventional cymbals, such as, without limitation, in the form of a broad-brim hat wherein the use of conventional cymbals allows the musician to employ conventional acoustical "striking" techniques while playing the electronic cymbal apparatus.

The electronic cymbal apparatus comprises a first cymbal substrate having a top surface and a bottom surface wherein said first cymbal substrate is made of a material which produces a prolonged vibratory response having a prolonged resonating acoustical tone; a second cymbal substrate having a bottom surface and a top surface abuttingly coupled against said bottom surface of said first cymbal substrate to significantly shorten said prolonged vibratory response having a prolonged resonating acoustical tone to produce a significantly shortened vibratory response; and, a transducer means, coupled to said second cymbal substrate, for picking up said significantly shortened vibratory response.

In view of the above, it is an object of the present invention to provide an electronic cymbal apparatus which has the same feel as a conventional cymbal instrument.

Another object of the present invention is to provide an electronic cymbal apparatus which can be played using convention drum sticks or any other means useable to strike a cymbal substrate.

It is a further object of an alternate embodiment of the present invention to provide such an electronic cymbal apparatus with a non-electrically conductive substrate sandwiched between two electrically conductive cymbal substrates to produce an open circuit between such two electrically conductive cymbal substrates.

It is a still further object of the alternate embodiment of the present invention to close the such open circuit when the musician chokes or grasps with his/her hand the two electrically conductive cymbal substrates.

In view of the above objects, it is a feature of the present invention to provide an electronic cymbal apparatus which is easy to use.

It is another feature of the present invention to provide an electronic cymbal apparatus which is simple and inexpensive to manufacture.

The above and other objects and features of the present invention will become apparent from the drawings, the description given herein, and the appended claims.

BRIEF DESCRIPTION OF THE DRAWING

For a further understanding of the nature and objects of the present invention, reference should be had to the following description taken in conjunction with the accompanying drawings in which like parts are given like reference numerals and, wherein:

FIG. 3 is an exploded perspective view of an alternate embodiment of the electronic cymbal apparatus of the present invention;

FIG. 4 is an exploded side view of the electronic cymbal apparatus of the embodiment of FIG. 2; and, FIG. 5 is a top view of the non-electrically conductive substrate of the embodiment of FIG. 2.

DETAILED DESCRIPTION OF THE PREFERRED EMBODIMENT

Figure 2:
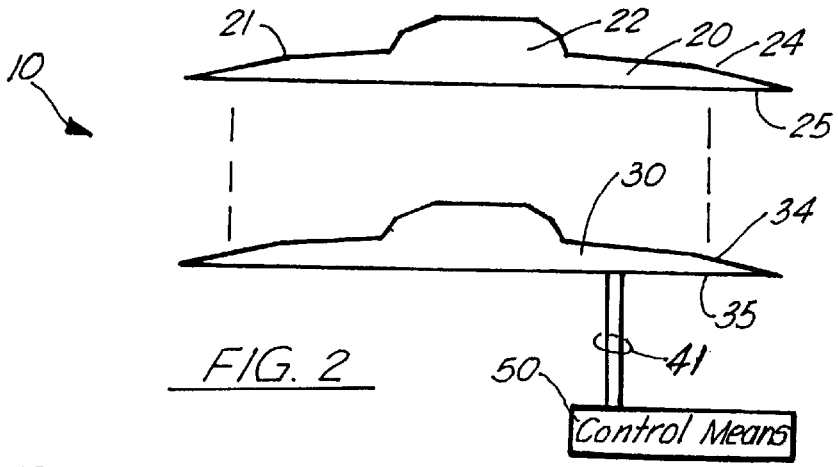
FIG. 2 is an exploded side view of the electronic cymbal apparatus of the embodiment of FIG. 1.
Figure 1:
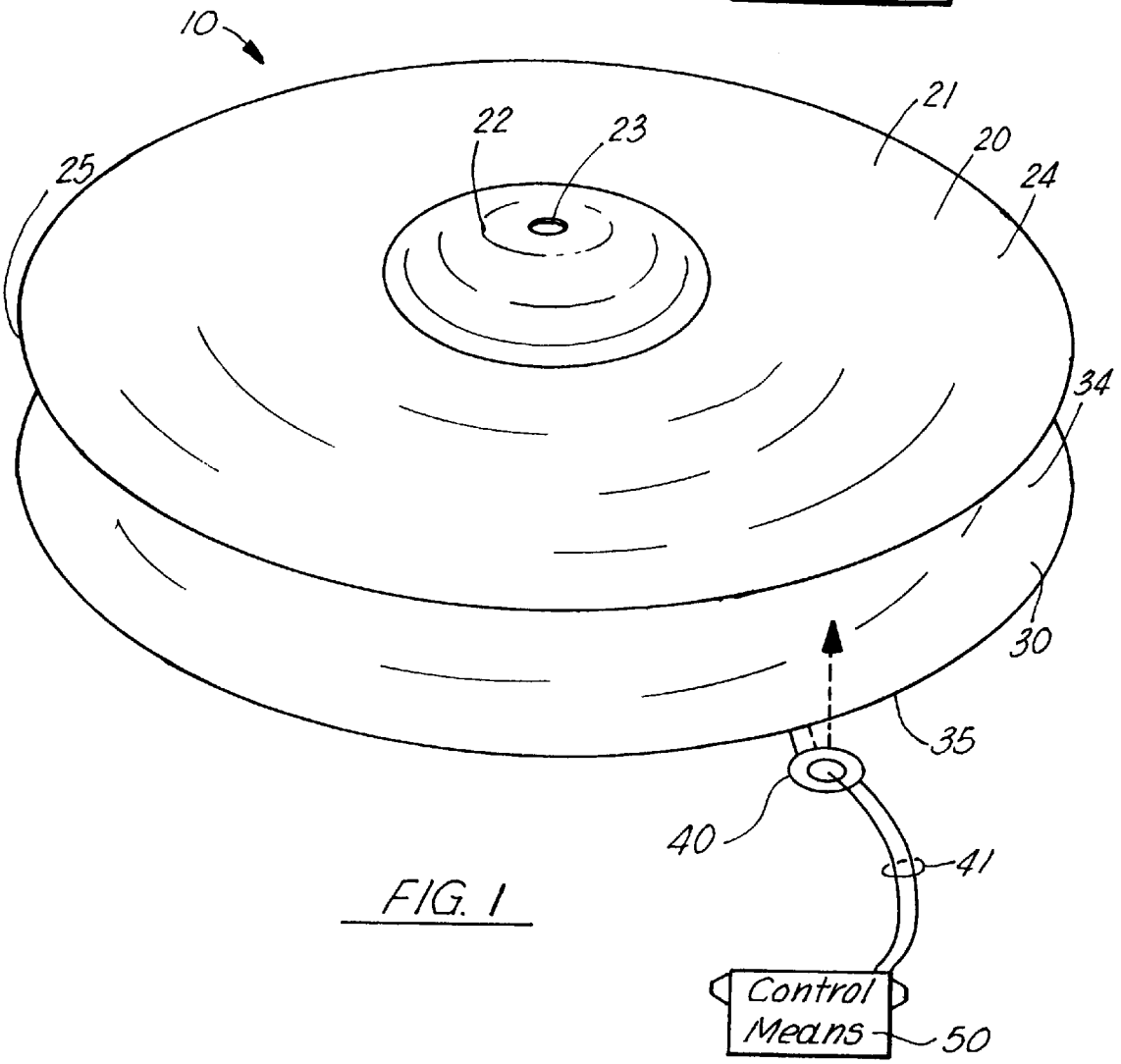
FIG. 1 is an exploded perspective view of the electronic cymbal apparatus of the present invention.

Referring now to the drawing, and in particular FIGS. 1 and 2, the electronic cymbal apparatus of the present invention is designated generally by the numeral 10. Electronic cymbal apparatus 10 is generally comprised of first cymbal substrate 20, second cymbal substrate 30, transducer means 40 and control means 50.

First cymbal substrate 20 and second cymbal substrate 30 comprise conventional musical cymbals made of electrically conductive (metallic) material such as, without limitation, brass or bronze alloy. Thereby, first cymbal substrate 20 and second cymbal substrate 30 have the same form, weight, mass, thickness and diameter to produce the same playing feel and acoustical tones of conventional musical cymbals. Moreover, said electrical conductive material produces a vibratory response having prolonged resonating acoustical tone when struck by a striking means, such as, without limitation, drum sticks or hand.

As can be appreciated, using conventional cymbal instruments for such substrates allow the musician to employ conventional acoustical "striking" techniques while playing electronic cymbal apparatus 10. Furthermore, the simulation of the musical sound desired is simplified since such simulation is based on such existing "striking" techniques and the varying amplitudes of the shortened vibratory response from the percussive impact.

Since first cymbal substrate 20 and second cymbal substrate 30 are essentially identical, only one such cymbal substrate will be described in detail. First cymbal substrate 20 is substantially shaped in the form of a broad-brimmed hat having brim 21 and small boss 22 in the center of brim 21. Boss 22 comprises aperture 23 for coupling first cymbal substrate 20 to a conventional cymbal stand (not shown).

The broad-brimmed hat shape of second cymbal substrate 30 is substantially the same as that of first cymbal substrate 20. Second cymbal substrate 30 is parallelly aligned with first cymbal substrate 20 such that top surface 34 of second cymbal substrate 30 abuts bottom surface 25 of first cymbal substrate 20. Abutting top surface 34 of second cymbal substrate 30 and first cymbal substrate 20 serves to significantly shorten the vibratory response having a prolonged resonating acoustical tone as first cymbal substrate 20 is subjected to a percussive impact by said striking means (not shown).

Transducer means 40, affixed to bottom surface 35 of second cymbal substrate 30, translates the amplitude of the significantly shortened vibratory response produced by the percussive impact by said striking means (not shown) into an electrical signal and for communicating such electrical signal to control means 50. As the percussive impacts vary, transducer means 40 translates the varying amplitudes of the varying significantly shortened vibratory responses in to varying electrical signals interpretable by control means 50. In the preferred embodiment, transducer means 40 is a piezoelectric transducer, such as described in U.S. Pat. No. 4,479,412, by Klynas, incorporated herein by reference as if set forth in full below. Nevertheless, other commercially available transducers useable with an electronic percussion instrument may be substituted. Transducer means 40 coupled to control means 50 via cable 41.

Control means 50 serves to process electrical signals from transducer means 40' and translate such into electronically produced sounds. Control means 50 may be any such processing system which serves to create an additional sound via sound synthesis, direct analog-to-digital conversion or analog voltage to digital information converter such as a MIDI (musical instrument digital interface) system.

In operation, first cymbal substrate 20 and second cymbal substrate 30 are coupled to a conventional cymbal stand wherein first cymbal substrate 20 and second cymbal substrate 30 are abuttingly coupled together. When playing a musical arrangement, top surface 24 of first cymbal substrate 20 is struck by said striking means (not shown). First cymbal substrate 20 ordinarily produces a prolonged vibratory response having a prolonged resonating acoustical tone. However, since top surface 34 of second cymbal substrate 30 abuts bottom surface 25 such prolonged vibratory response having a prolonged resonating acoustical tone is significantly shortened.

Transducer means 40 picks up such significantly shortened vibratory response having a shortened resonating acoustical tone and translates the amplitude of such significantly shortened vibratory response into an electrical signal. Such electrical signal is then conveyed to control means 50.

Control means 50 interprets such electrical signal to produce an electronically produced musical sound for use in both musical recordings and musical performances. Control means 50 is responsive to varying electrical signals conveyed by transducer means 40.

Referring now to FIGS. 3–5, an alternate embodiment of the present invention is shown. Electronic cymbal apparatus 10' is generally comprised of first cymbal substrate 20', second cymbal substrate 30', transducer means 40', control means 50' and non-electrically conductive substrate 60. Electronic cymbal apparatus 10', of the alternative embodiment, differs from electronic cymbal apparatus 10 in that non-electrically conductive substrate 60 is sandwiched between first cymbal substrate 20' and second cymbal substrate 30'. Thereby an open circuit exists between first cymbal substrate 20' and second cymbal substrate 30'. Said open circuit exists even after the percussive impact by said striking means (not shown). The musician can close said open circuit by grasping or choking first cymbal substrate 20' and second cymbal substrate 30' in a conventional manner after a percussive impact to the striking surface of first cymbal substrate 20'. In the preferred embodiment, top surface 24' of first cymbal substrate 20' is electrically coupled to control means 50' via wire 62 and bottom surface 35' of second cymbal substrate 30' is electrically coupled to control means 50' via wire 63. When first and second cymbal substrates 20' and 30' are grasped or choked via the hand, an electrically closed circuit between wire 62 and 63 is formed. The closed circuit produced by such grasping or choking is also translated by control means 50' via wires 62 and 63.

Non-electrically conductive substrate 60 is dimensioned to the contour of bottom surface 25' of first cymbal substrate 20' and to the contour of top surface 34' of second cymbal substrate 30' such that the electrically conductive surfaces of first cymbal substrate 20' and second cymbal substrate 30' are not in contact with each other.

The operation of the alternative embodiment differs from the embodiment above, in FIGS. 1–2, only in that the closing of said open circuit allows the musician to further vary the electronically produced musical sound with known cymbal playing techniques for use in both musical recordings and musical performances with a criteria of a closed circuit.

Alternately, in lieu of non-electrically conductive substrate 60, a substrate made of material which would serve to close said open circuit between first cymbal substrate 20' and second cymbal substrate 30' when pressure via a grasp is applied thereto may be substituted.

Because many varying and differing embodiments may be made within the scope of the inventive concept herein taught and because many modifications may be made in the embodiment herein detailed in accordance with the descriptive requirement of the law, it is to be understood that the details herein are to be interpreted as illustrative and not in a limiting sense.

What is claimed as invention is:

1. An electronic cymbal apparatus comprising:

(a) a first cymbal substrate having a top surface and a bottom surface wherein said first cymbal substrate is made of a material which produces a prolonged vibratory response having a prolonged resonating acoustical tone;

(b) a second cymbal substrate having a bottom surface and a top surface abuttingly coupled against said bottom surface of said first cymbal substrate to significantly shorten said prolonged vibratory response having a prolonged resonating acoustical tone to produce a significantly shortened vibratory response; and, (c) a transducer means, coupled to said second cymbal substrate, for picking up said significantly shortened vibratory response.

2. The apparatus of claim 1, further comprising a control means for processing electrical signals convey by said transducer means in response to said significantly shortened vibratory response wherein said control means is a processing system which serves to create an additional sound via sound synthesis, a direct analog-to-digital conversion or an analog voltage to digital information converter.

3. The apparatus of claim 1, wherein said first cymbal substrate and said second cymbal substrate have a broad-brim hat shape.

4. The apparatus of claim 1, wherein said first cymbal substrate and said second cymbal substrate are electrically conductive.

5. The apparatus of claim 4, further comprising a non-electrically conductive substrate sandwiched between said first cymbal substrate and said second cymbal substrate for producing an open circuit between said first cymbal substrate and said second cymbal substrate.

6. The apparatus of claim 5, wherein said open circuit is closed when a musician grasps or chokes said shortened vibratory response of said first cymbal substrate and said second cymbal substrate with a hand.

7. The apparatus of claim 6, wherein when said open circuit is closed a closed circuit is formed, said closed circuit comprises a first wire coupled to said first cymbal substrate and to a control means for creating additional sound, a second wire coupled to said second cymbal substrate and to said control means and said hand grasping said first cymbal substrate and said second cymbal substrate.

8. The apparatus of claim 4, wherein said material of said first cymbal substrate comprises brass or bronze alloy and said second cymbal substrate is made of brass or bronze alloy.

9. An electronic cymbal apparatus comprising:

(a) a first cymbal having a top surface and a bottom surface wherein said first cymbal produces in response to percussive impacts a prolonged vibratory response having a prolonged resonating acoustical tone;

(b) a second cymbal having a bottom surface and a top surface abuttingly coupled against said bottom surface of said first cymbal to significantly shorten said prolonged vibratory response having a prolonged resonating acoustical tone to produce a significantly shortened vibratory response; and, (c) a transducer means, coupled to said second cymbal, for picking up said significantly shortened vibratory response.

10. The apparatus of claim 9, further comprising a control means for processing electrical signals convey by said transducer means in response to said significantly shortened vibratory response wherein said control means is a processing system which serves to create an additional sound via sound synthesis, a direct analog-to-digital conversion or an analog voltage to digital information converter.

11. The apparatus of claim 9, wherein said first cymbal and said second cymbal have a broad-brim hat shape.

12. The apparatus of claim 9, wherein said first cymbal and said second cymbal are made of brass or bronze alloy.

13. An electronic cymbal apparatus comprising:

(a) a first cymbal substrate having a top surface and a bottom surface wherein said first cymbal substrate is made of an electrically conductive material which produces a prolonged vibratory response having a prolonged resonating acoustical tone;

(b) a second cymbal substrate made of an electrically conductive material and having a bottom surface and a top surface abuttingly coupled against said bottom surface of said first cymbal substrate to significantly shorten said prolonged vibratory response having a prolonged resonating acoustical tone to produce a significantly shortened vibratory response;

(c) a non-electrically conductive substrate sandwiched between said first cymbal substrate and said second cymbal substrate for producing an open circuit between said first cymbal substrate and said second cymbal substrate; and, (d) a transducer means, coupled to said second cymbal substrate, for picking up said significantly shortened vibratory response.

14. The apparatus of claim 13, further comprising a control means for processing electrical signals convey by said transducer means in response to said significantly shortened vibratory response wherein said control means is a processing system which serves to create an additional sound via sound synthesis, a direct analog-to-digital conversion or an analog voltage to digital information converter.

15. The apparatus of claim 13, wherein said first cymbal substrate and said second cymbal substrate has a broad-brim hat shape.

16. The apparatus of claim 13, wherein said open circuit is closed when a musician grasps or chokes said shortened vibratory response of said first cymbal substrate and said second cymbal substrate with a hand.

17. The apparatus of claim 16, wherein when said open circuit is closed a closed circuit is formed, said closed circuit comprises a first wire coupled to said first cymbal substrate and to a control means for creating additional sound, a second wire coupled to said second cymbal substrate and to said control means and said hand grasping said first cymbal substrate and said second cymbal substrate.

18. The apparatus of claim 13, wherein said electrically conductive material of said first cymbal substrate and said second cymbal substrate is brass or bronze alloy.

* * * * *